US007724189B2

(12) United States Patent
Lee

(10) Patent No.: US 7,724,189 B2
(45) Date of Patent: May 25, 2010

(54) BROADBAND BINARY PHASED ANTENNA

(75) Inventor: Gregory S. Lee, Mountain View, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 1222 days.

(21) Appl. No.: 10/997,583

(22) Filed: Nov. 24, 2004

(65) Prior Publication Data

US 2006/0119513 A1 Jun. 8, 2006

(51) Int. Cl.
*H01Q 3/02* (2006.01)
*H01Q 1/38* (2006.01)
*H01Q 5/00* (2006.01)
*H01Q 9/04* (2006.01)

(52) U.S. Cl. ..... 342/374; 343/700 MS

(58) Field of Classification Search ..... 342/374, 342/778, 853, 368; 343/700 MS
See application file for complete search history.

(56) References Cited

U.S. PATENT DOCUMENTS 3,276,018 A * 9/1966 Butler ..... 342/373
3,295,134 A * 12/1966 Lowe ..... 342/368
3,295,138 A * 12/1966 Nelson ..... 342/375
3,364,492 A 1/1968 Griffee
3,524,192 A * 8/1970 Sakiotis et al. ..... 342/374
3,525,995 A * 8/1970 Schroeder ..... 343/777
3,714,655 A * 1/1973 Ross et al. ..... 342/373
3,803,621 A 4/1974 Britt
3,922,680 A * 11/1975 Alsberg et al. ..... 343/754
3,993,999 A * 11/1976 Hemmi et al. ..... 342/372
4,005,425 A * 1/1977 Nagy ..... 342/174
4,045,800 A * 8/1977 Tang et al. ..... 342/372
4,070,639 A 1/1978 Nemit et al.
4,088,970 A * 5/1978 Fassett et al. ..... 333/150
4,502,025 A 2/1985 Carl, Jr. et al.
4,587,525 A 5/1986 Parsons et al.
4,626,858 A * 12/1986 Copeland ..... 342/374
4,649,393 A * 3/1987 Rittenbach ..... 342/371
4,751,453 A * 6/1988 Foti ..... 323/212
4,772,893 A * 9/1988 Iwasaki ..... 343/779
4,791,421 A * 12/1988 Morse et al. ..... 342/368
4,800,393 A 1/1989 Edward et al.
4,885,592 A 12/1989 Kofol et al.
4,916,453 A * 4/1990 Costas ..... 342/368
5,027,125 A * 6/1991 Tang ..... 342/368
5,039,959 A * 8/1991 Young ..... 332/105
5,206,655 A * 4/1993 Caille et al. ..... 343/700 MS
5,268,692 A * 12/1993 Grosch et al. ..... 342/70
5,499,031 A * 3/1996 Bodonyi ..... 342/174
5,708,436 A * 1/1998 Loiz et al. ..... 342/25 A
5,940,030 A 8/1999 Hampel et al.

(Continued)

OTHER PUBLICATIONS

European Search Report dated Feb. 14, 2006.

*Primary Examiner*—Thomas H Tarcza
*Assistant Examiner*—Harry Liu

(57) ABSTRACT

A broadband binary phased antenna includes an array of symmetric antenna elements, each being connected to a respective symmetric switch. The symmetric antenna elements are each symmetrical about a mirror axis of the antenna element and include feed points on either side of the mirror axis capable of creating opposite symmetric field distributions across the symmetric antenna element. The opposite symmetric field distributions are binary phase-shifted with respect to one another. The symmetric switch is connected to the feed points to selectively switch between the opposite symmetric field distributions.

12 Claims, 3 Drawing Sheets

U.S. PATENT DOCUMENTS

| | | | | |
|---|---|---|---|---|
| 5,940,045 | A | 8/1999 | Belcher et al. | |
| 5,986,590 | A | 11/1999 | Smith et al. | |
| 6,043,786 | A | 3/2000 | Vannatta et al. | |
| 6,262,690 | B1 * | 7/2001 | Malone et al. | 343/850 |
| 6,480,153 | B1 * | 11/2002 | Jung et al. | 342/368 |
| 6,509,883 | B1 * | 1/2003 | Foti et al. | 343/850 |
| 6,549,166 | B2 | 4/2003 | Bhattacharyya et al. | |
| 6,597,316 | B2 * | 7/2003 | Rao et al. | 343/700 MS |
| 6,642,889 | B1 | 11/2003 | McGrath | |
| 6,965,340 | B1 * | 11/2005 | Baharav et al. | 342/22 |
| 6,992,621 | B2 * | 1/2006 | Casas et al. | 342/373 |
| 7,009,557 | B2 * | 3/2006 | Kirchofer et al. | 342/359 |
| 7,183,963 | B2 * | 2/2007 | Lee et al. | 342/22 |
| 7,254,371 | B2 * | 8/2007 | Inui et al. | 455/78 |
| 2003/0107517 | A1 * | 6/2003 | Ikeda et al. | 342/372 |
| 2003/0193377 | A1 | 10/2003 | Quan et al. | |
| 2004/0036523 | A1 * | 2/2004 | Dueme et al. | 327/407 |
| 2006/0109174 | A1 * | 5/2006 | Baharav et al. | 342/179 |
| 2006/0182201 | A1 * | 8/2006 | Lindenmeier et al. | 375/332 |
| 2006/0214835 | A1 * | 9/2006 | Lee et al. | 342/22 |

* cited by examiner

BROADBAND BINARY PHASED ANTENNA

CROSS-REFERENCE TO RELATED APPLICATION

This application is related by subject matter to U.S. application for patent Ser. No. 11/148,079, entitled "System and Method for Security Inspection Using Microwave Imaging," filed on even date herewith.

BACKGROUND OF THE INVENTION

Phased antenna arrays provide beamforming and beam-steering capabilities by controlling the relative phases of electrical signals applied across antenna elements of the array. The two most common types of phased antenna arrays are continuous phased arrays and binary phased arrays.

Continuous phased arrays use analog phase shifters that can be adjusted to provide any desired phase shift in order to steer a beam towards any direction in a beam scanning pattern. However, continuous phased arrays are typically either lossy or expensive. For example, most continuous phase shifters are based on varactor-tapped delay lines using variable capacitive and/or variable inductance elements. Variable capacitive elements, such as varactor diodes and ferroelectric capacitors, are inherently lossy due to resistive constituents or poor quality in the microwave region. Variable inductance elements, such as ferromagnetic devices, are bulky, costly and require large drive currents.

Binary phased arrays use phase shifters capable of providing two different phase shifts of opposite polarity (e.g., 0 and 180°). Binary phase shifters are typically implemented using diode or transistor switches that either open/short the antenna element to ground or upshift/downshift the antenna element's resonant frequency. Diode switches are most commonly used in narrowband applications with small antenna arrays. However, in large antenna arrays, transistors are generally preferred due to the excessive dc and switching currents required to switch a large number of diodes. For broadband applications, high-frequency, high-performance field effect transistor (FET's) are required, which substantially increases the cost of the binary phase shifter. For example, the current cost of a 5-GHz FET is usually around $0.20-$0.30, whereas the current cost of a 20-30 GHz FET is upwards of $5.00.

Therefore, what is needed is a cost-effective binary phase-shifting mechanism for broadband antenna arrays.

SUMMARY OF THE INVENTION

Embodiments of the present invention provide a broadband binary phased antenna that includes an array of symmetric antenna elements, each being connected to a respective symmetric switch. The symmetric antenna elements are each symmetrical about a mirror axis of the antenna element and include feed points on either side of the mirror axis capable of creating opposite symmetric field distributions across the symmetric antenna element. The opposite symmetric field distributions are binary phase-shifted with respect to one another. The symmetric switch is connected to the feed points to selectively switch between the opposite symmetric field distributions.

In one embodiment, the feed points are positioned symmetrically about the mirror axis. For example, the feed points can be positioned at the midpoint of the symmetric antenna element on either side of the mirror axis.

In another embodiment, the switch includes first and second terminals, and is symmetric in the operating states between the first and second terminals.

In a further embodiment, the antenna is a retransmit antenna including a second antenna element connected to the symmetric switch. The symmetric switch selectively connects one of the feed points on the symmetric antenna element to the second antenna element. In one implementation embodiment, the second antenna element is the symmetric antenna element fed with an orthogonal polarization.

In still a further embodiment, the symmetric antenna element is a slot antenna element. In one implementation embodiment, a first feed line is connected between a first terminal of the symmetric switch and a first feed point of the slot antenna element across the slot antenna element, and a second feed line is connected between a second terminal of the symmetric switch and a second feed point of the slot antenna element across the slot antenna element. In another implementation embodiment, a feed line is connected between the feed points of the slot antenna element and is also connected to the terminals of the symmetric switch. In this embodiment, the feed line has an electric feed length between the slot antenna element and the symmetric switch of approximately 90 degrees.

Advantageously, embodiments of the present invention enable binary phase-switching of broadband or multi-band antenna arrays without requiring high performance switches. Furthermore, the invention provides embodiments with other features and advantages in addition to or in lieu of those discussed above. Many of these features and advantages are apparent from the description below with reference to the following drawings.

BRIEF DESCRIPTION OF THE DRAWINGS

The disclosed invention will be described with reference to the accompanying drawings, which show important sample embodiments of the invention and which are incorporated in the specification hereof by reference, wherein.

DETAILED DESCRIPTION OF THE EXEMPLARY EMBODIMENTS

Figure 1:
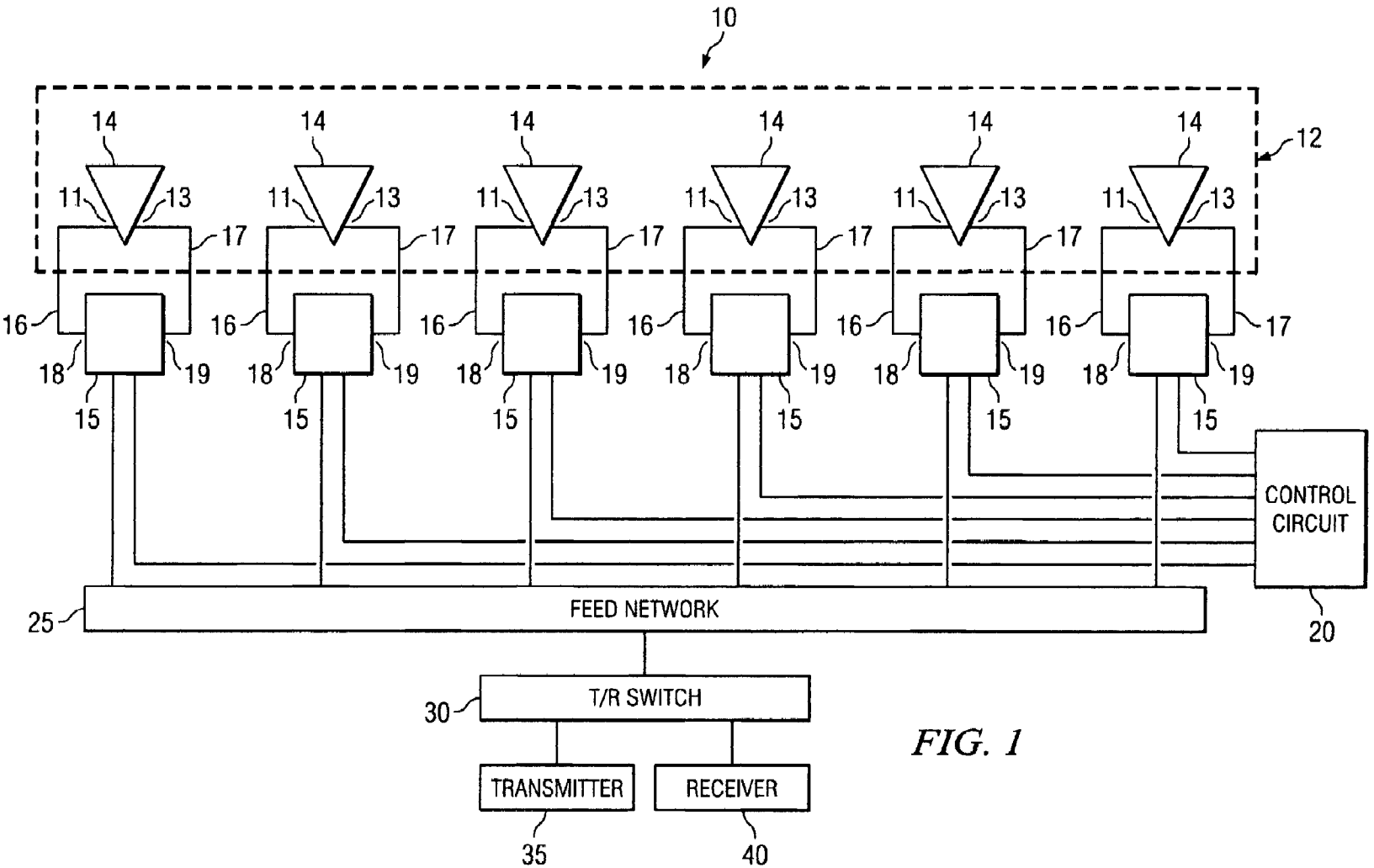
FIG. 1 is a schematic diagram of a simplified exemplary broadband binary phase-switched antenna, in accordance with embodiments of the present invention.

FIG. 1 is a schematic diagram of a simplified exemplary broadband binary phased antenna 10, in accordance with embodiments of the present invention. The antenna 10 includes an array 12 of antenna elements 14. For ease of illustration, only six antenna elements 14 are shown in FIG. 1. However, it should be understood that the array 12 may include any number of antenna elements 14. In addition, the antenna elements 14 may be capable of one or both of transmitting and receiving.

Each antenna element 14 is connected to a respective switch 15 via feed lines 16 and 17. The switch 15 can be, for example, a single-pole double-throw (SPDT) switch or a double-pole double-throw (DPDT) switch. Thus, feed line 16 connects between a first feed point 11 on the antenna element 14 and a first terminal 18 of the switch 15, and feed line 17 connects between a second feed point 13 on the antenna element 14 and a second terminal 19 of the switch 15.

The operating state of a particular switch 15 controls the phase of the respective antenna element 14. For example, in a first operating state of the switch 15, the respective antenna element 14 may be in a first binary state (e.g., 0 degrees), while in a second operating state of the switch 15, the respective antenna element 14 may be in a second binary state (e.g., 180 degrees). The operating state of the switch 15 defines the terminal connections of the switch 15. For example, in the first operating state, terminal 18 may be in a closed (short circuit) position to connect feed line 16 between the antenna element 14 and the switch 15, while terminal 19 may be in an open position. The operating state of each switch 15 is independently controlled by a control circuit 20 to individually set the phase of each antenna element 14.

In a transmit mode, a transmit/receive (T/R) switch 30 switches a transmit signal from a transmitter 35 to a feed network 25. The feed network 25 supplies the transmit signal to each of the switches 15. Depending on the state of each switch 15, as determined by the control circuit 20, the phase of the signal transmitted by each antenna element 14 is in one of two binary states. The particular combination of binary phase-switched signals transmitted by the antenna elements 14 forms an energy beam radiating from the array 12.

In a receive mode, incident energy is captured by each antenna element 14 in the array 12 and binary phase-shifted by each antenna element 14 according to the state of the respective switch 15 to create respective receive signals. All of the binary phase-shifted receive signals are combined in the feed network 25 to form the receive beam, which is passed to a receiver 40 through the T/R switch 30.

Figure 2:
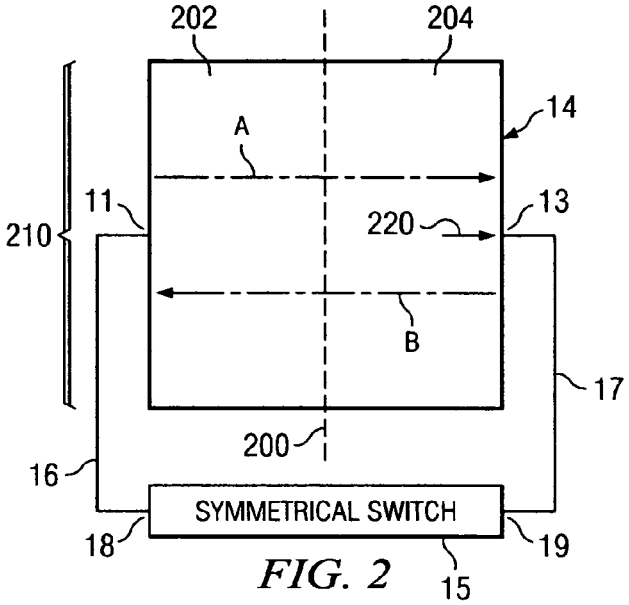
FIG. 2 is a schematic diagram of a simplified exemplary symmetric antenna element and symmetric switch of the broadband binary phase-switched antenna of FIG. 1, in accordance with embodiments of the present invention.

FIG. 2 is a schematic diagram of a simplified exemplary symmetric antenna element 14 and symmetric switch 15 of the broadband binary phase-switched antenna 10 of FIG. 1, in accordance with embodiments of the present invention. As used herein, the term symmetric antenna element 14 refers to an antenna element that can be tapped or fed at either of two feed points 11 or 13 to create one of two opposite symmetric field distributions or electric currents.

As shown in FIG. 2, the two opposite symmetric field distributions are created by using a symmetric antenna 14 that is symmetric in shape about a mirror axis 200 thereof. The mirror axis 200 passes through the antenna element 14 to create two symmetrical sides 202 and 204. The feed points 11 and 13 are located on either side 202 and 204 of the mirror axis 200 of the antenna element 14. In one embodiment, the feed points 11 and 13 are positioned on the antenna element 14 substantially symmetrical about the mirror axis 200. For example, the mirror axis 200 can run parallel to one dimension 210 (e.g., length, width, height, etc.) of the antenna element 14, and the feed points 11 and 13 can be positioned near a midpoint 220 of the dimension 210. In FIG. 2, the feed points 11 and 13 are shown positioned near a midpoint 220 of the antenna element 14 on each side 202 and 204 of the mirror axis 200.

The symmetric antenna element 14 is capable of producing two opposite symmetric field distributions, labeled A and B. The magnitude (e.g., power) of field distribution A is substantially identical to the magnitude of field distribution B, but the phase of field distribution A differs from the phase of field distribution B by 180 degrees. Thus, field distribution A resembles field distribution B at ±180° in the electrical cycle.

The symmetric antenna element 14 is connected to a symmetric switch 15 via feed lines 16 and 17. Feed point 11 is connected to terminal 18 of the symmetric switch 15 via feed line 16, and feed point 13 is connected to terminal 19 of the symmetric switch 15 via feed line 17. As used herein, the term symmetric switch refers to either a SPDT or DPDT switch in which the two operating states of the switch are symmetric about the terminals 18 and 19.

For example, if in a first operating state of a SPDT switch, the impedance of channel $\alpha$ is 10Ω and the impedance of channel $\beta$ is 1 kΩ, then in the second operating state of the SPDT switch, the impedance of channel $\alpha$ is 1 kΩ and the impedance of channel $\beta$ is 10Ω. It should be understood that the channel impedances are not required to be perfect opens or shorts or even real. In addition, there may be crosstalk between the channels, as long as the crosstalk is state-symmetric. In general, a switch is symmetric if the S-parameter matrix of the switch is identical in the two operating states of the switch (e.g., between the two terminals 18 and 19).

Figure 3:
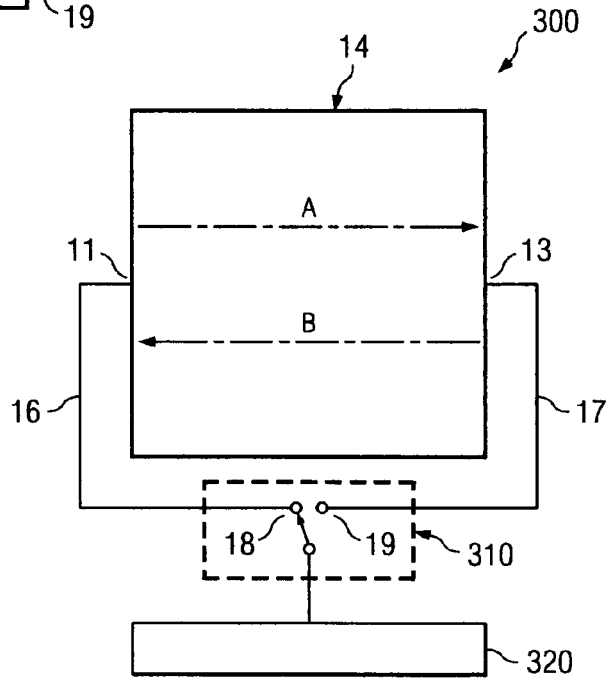
FIG. 3 is a schematic diagram of a simplified exemplary broadband binary phased retransmit antenna, including a symmetric antenna element and symmetric switch, in accordance with embodiments of the present invention.

FIG. 3 is a schematic diagram of a simplified exemplary broadband binary phased retransmit antenna 300, in accordance with embodiments of the present invention. The retransmit antenna 300 includes a symmetric antenna element 14, a symmetric SPDT switch 310, and a second antenna element 320. The symmetric antenna element 14 can be, for example, part of an array 12 of symmetric antenna elements 14, as shown in FIG. 1. The second antenna element 320 can be, for example, part of another array (not shown) of antenna elements or a second mode of the symmetric antenna element 14.

The second antenna element 320 need not be a symmetric antenna element, but instead can be any type of antenna element compatible with the symmetric antenna element 14. For example, the symmetric antenna element 14 can be a microstrip patch antenna element, and the second antenna element 320 can be a slot antenna element or a monopole ("whip") antenna element. In one embodiment, the second antenna element 320 is geometrically constructed to have negligible mutual coupling to the symmetric antenna element 14.

In a first operating state of the symmetric switch 310, as shown in FIG. 3, terminal 18 of the switch 310 connects feed point 11 of the symmetric antenna element 14 to the second antenna element 320. In a second operating state, terminal 19 of the symmetric switch 310 connects feed point 13 of the symmetric antenna element 14 to the second antenna element 320. Thus, in the first operating state, the switch 310 preferentially samples field distribution A over field distribution B and transfers power to the second antenna element 320 for retransmission. In the second operating state, the switch 310 preferentially samples field distribution B over field distribution A and transfers power to the second antenna element 320 for retransmission. Due to symmetry in the symmetrical antenna element 14 and the switch 310, the retransmit power is identical in the two operating states of the switch 310, but the phase differs by 180°.

Figure 4:
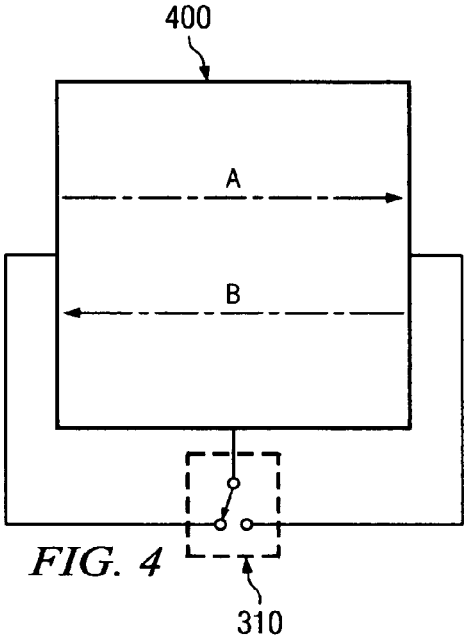
FIG. 4 is a schematic diagram of an exemplary symmetric microstrip patch antenna, in accordance with embodiments of the present invention.

FIG. 4 is a schematic diagram of an exemplary symmetric microstrip patch antenna element 400, in accordance with embodiments of the present invention. The symmetric microstrip patch antenna element 400 can be, for example, part of an array 12 of symmetric microstrip patch antenna elements 14, as shown in FIG. 1. The symmetric microstrip patch antenna element 400 is a patch that is nearly m+½ wavelengths long (where m is an integer) and tapped on both ends. To implement a retransmit antenna, the second antenna element can be another patch on either the same side of the printed circuit board (for reflect arrays) or the opposite side of the printed circuit board (for transmit arrays). For example, in FIG. 4, the second antenna element can be realized by feeding the same symmetric microstrip patch antenna element 400 in an orthogonal polarization. In this reflect configuration, the reflected wave is transversely polarized to the incoming wave.

Figure 5:
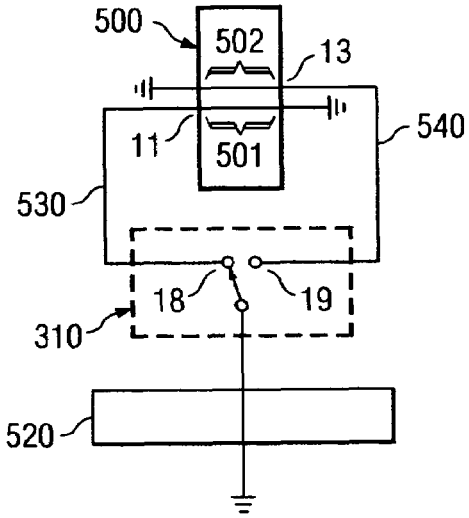
FIG. 5 is a schematic diagram of an exemplary symmetric slot antenna with two feed lines, in accordance with embodiments of the present invention.

FIG. 5 is a schematic diagram of an exemplary symmetric slot antenna element 500 with two feed lines 530 and 540, in accordance with embodiments of the present invention. The symmetric slot antenna element 500 can be, for example, part of an array 12 of symmetric slot antenna elements 14, as shown in FIG. 1. The symmetric slot antenna element 500 has a length that is nearly m+½ wavelengths long (where m is an integer). The symmetric slot antenna 500 is fed simultaneously by two slightly off-center feed lines 530 and 540, each being shorted to the ground plane on opposite sides of the slot 500 by slot-crossing strips 501 and 502, respectively. Thus, a first feed line 530 is connected between a first terminal 18 of the symmetric switch 310 and a first feed point 11, which in turn is connected by slot-crossing strip 501 across the slot element 500 to ground, and a second feed line 540 is connected between a second terminal 19, which in turn is connected by slot-crossing strip 502 across the slot element 500 to ground. A second slot antenna element 520 is shown connected to the SPDT switch 310 to enable retransmission of signals received by the symmetric slot 500 or the second slot 520.

Figure 6:
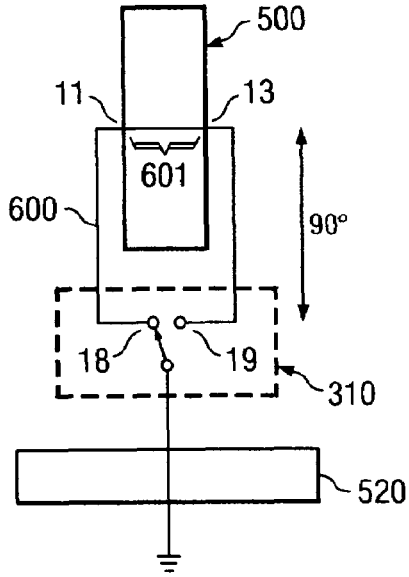
FIG. 6 is a schematic diagram of an exemplary symmetric slot antenna with a single feed line, in accordance with embodiments of the present invention.

FIG. 6 is a schematic diagram of an exemplary symmetric slot antenna element 500 with a single feed line 600, in accordance with embodiments of the present invention. As in FIG. 5, the symmetric slot antenna element 500 can be, for example, part of an array 12 of symmetric slot antenna elements 14, as shown in FIG. 1. In FIG. 6, the ground shorts have been removed, and the slot antenna element 500 is fed with a single feed line 600 whose ends connect to opposite terminals 18 and 19 of the SPDT switch 310. Thus, the feed line 600 is connected between the feed points 11 and 13 of the slot antenna element 500 and connected to the terminals 18 and 19 of the symmetric switch 310. The feed line 600 also includes a single slot-crossing strip 601, which connects the feed points 11 and 13 across the center of the slot element 500. In one embodiment, the electrical feed length of the feed line 600 between the feed point 11 and the switch terminal 18 and between the feed point 13 and the switch terminal 19 is approximately 90 degrees so that the open terminal presents a virtual ac short back at the slot 500 edge opposite the closed terminal. A second slot antenna element 520 is also shown in FIG. 6 connected to the SPDT switch 310 to enable retransmission of signals received by the symmetric slot 500 or the second slot 520.

Figure 7:
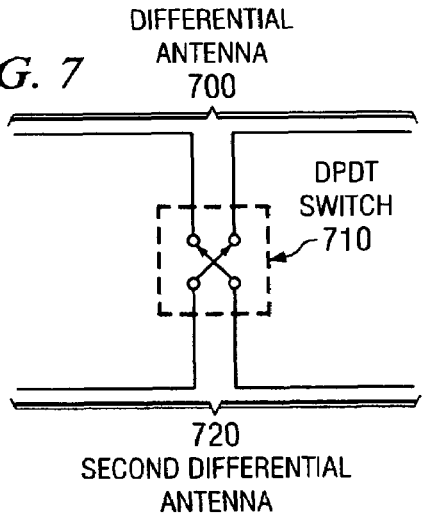
FIG. 7 is a schematic diagram of an exemplary symmetric differential antenna, in accordance with embodiments of the present invention.

FIG. 7 is a schematic diagram of an exemplary symmetric differential antenna element 700, in accordance with embodiments of the present invention. The symmetric differential antenna element 700 can be, for example, part of an array 12 of symmetric slot antenna elements 14, as shown in FIG. 1. In FIG. 7, both the symmetric antenna element 700 and the second antenna element 720 are differential antenna elements. However, the second antenna element 720 need not be symmetric. In this example, a DPDT switch 710 is used as the symmetric switch. Examples of differential antennas include dipoles (as shown in FIG. 7), loops, vee antennas, bowties and Archimedes' spirals.

As will be recognized by those skilled in the art, the innovative concepts described in the present application can be modified and varied over a wide rage of applications. Accordingly, the scope of patents subject matter should not be limited to any of the specific exemplary teachings discussed, but is instead defined by the following claims.

I claim:

1. A broadband binary phased antenna, comprising:

a symmetric antenna element symmetrical about a mirror axis thereof and including feed points on either side of said mirror axis operable to create opposite symmetric field distributions across said symmetric antenna element, said opposite symmetric field distributions being binary phase-shifted with respect to one another; and a symmetric switch connected to said feed points and arranged to selectively switch between said opposite symmetric field distributions.

2. The antenna of claim 1, wherein said feed points include a first feed point on a first side of said mirror axis capable of creating a first field distribution across said symmetric antenna element and a second feed point on a second side of said mirror axis capable of creating a second field distribution across said symmetric antenna element, the magnitude of said first and second field distributions being substantially equivalent, the phase of said first distribution differing from the phase of said second field distribution by 180 degrees.

3. The antenna of claim 2, wherein said switch selectively connects to one of said first feed point and said second feed point.

4. The antenna of claim 2, wherein said first feed point and said second feed point are positioned on said symmetric antenna element substantially symmetrically about said mirror axis.

5. The antenna of claim 4, wherein said first feed point is positioned near a midpoint of said symmetric antenna element on said first side of said mirror axis and said second feed point is positioned near a midpoint of said symmetric antenna element on said second side of said mirror axis.

6. The antenna of claim 1, wherein said switch includes first and second terminals, the operating states of said switch being symmetric between said first and second terminals.

7. The antenna of claim 1, wherein said switch is a SPDT switch.

8. The antenna of claim 1, wherein said switch is a DPDT switch.

9. The antenna of claim 1, further comprising: a second antenna element connected to said symmetric switch, said symmetric switch selectively connecting one of said feed points to said second antenna element.

10. The antenna of claim 9, wherein said second antenna element is said symmetric antenna element fed in an orthogonal polarization.

11. A method for broadband binary phase-switching of an antenna, comprising the steps of:

providing an array of symmetric antenna elements, each being symmetrical about a mirror axis thereof; and feeding each of said symmetric antenna elements at one of two feed points positioned on either side of said mirror axis to create one of two opposite symmetric field distributions across said respective symmetric antenna element, said opposite symmetric field distributions being binary phase-shifted with respect to one another.

12. The method of claim 11, wherein said feeding further comprises:

feeding a select one of said symmetric antenna elements at either a first feed point on a first side of said mirror axis to create a first field distribution across said select symmetric antenna elements or a second feed point on a second side of said mirror axis to create a second field distribution across said select symmetric antenna elements, the magnitude of said first and second field distributions being substantially equivalent, the phase of said first distribution differing from the phase of said second field distribution by 180 degrees.

* * * * *